US006995723B1

(12) United States Patent
Adams

(10) Patent No.: US 6,995,723 B1
(45) Date of Patent: Feb. 7, 2006

(54) WEARABLE DIRECTIONAL ANTENNA

(75) Inventor: Richard C. Adams, Chula Vista, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 5 days.

(21) Appl. No.: 10/828,519

(22) Filed: Apr. 5, 2004

(51) Int. Cl.
*H01Q 1/12* (2006.01)

(52) U.S. Cl. ..... 343/718; 343/897

(58) Field of Classification Search ..... 343/718, 343/897, 793, 795; 455/562; 370/252
See application file for complete search history.

(56) References Cited

U.S. PATENT DOCUMENTS

| | | | | |
|---|---|---|---|---|
| 5,999,826 | A * | 12/1999 | Whinnett | 455/561 |
| 6,356,238 | B1 * | 3/2002 | Gainor et al. | 343/718 |
| 6,771,224 | B2 * | 8/2004 | Apostolos | 343/718 |
| 6,867,740 | B2 * | 3/2005 | Goodyear | 343/718 |
| 2003/0122655 | A1 * | 7/2003 | Hum et al. | 340/10.3 |
| 2004/0066754 | A1 * | 4/2004 | Hottinen | 370/252 |
| 2004/0147290 | A1 * | 7/2004 | Kikuchi | 455/562.1 |

* cited by examiner

*Primary Examiner*—Hoang V. Nguyen
(74) *Attorney, Agent, or Firm*—Allan Y. Lee; Michael A. Kagan; Peter A. Lipovsky

(57) ABSTRACT

A wearable directional antenna. The system includes a clothing, a plurality of EM energy reflectors and a plurality of antenna elements. The clothing includes a non-conductive material. The plurality of EM energy reflectors is operatively coupled to the clothing and is capable of reflecting EM energy. The plurality of antenna elements is operatively coupled to the plurality of EM energy reflectors and is capable of receiving and transmitting EM energy in a specified direction.

21 Claims, 7 Drawing Sheets

WEARABLE DIRECTIONAL ANTENNA

BACKGROUND OF THE INVENTION

The present invention is generally in the field of antennas. Typical antennas are neither wearable nor directional. A need exists for wearable directional antennas.

DETAILED DESCRIPTION OF THE INVENTION

The present invention is directed to wearable directional antennas. Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely exemplary embodiments of the invention. To maintain brevity, other embodiments of the invention that use the principles of the present invention are not specifically described in the present application and are not specifically illustrated by the present drawings.

DEFINITIONS

The following definitions and acronyms are used herein:

Acronym(s):

P—input transmission signal
AC—Alternating Current
Comm—Communication
I/O—Input/Output
EM—Electromagnetic
SPMTS—Single-Pole, Multi-Throw Switch
WDVA—Wearable Directional Vest Antenna
L—power Loss Definition(s):

Base Station—a transmitter/receiver used as a relay in communication systems such as cellular base stations or satellite stations.

The present inventive wearable directional antenna includes clothing, electromagnetic (EM) reflectors and antenna elements. In one embodiment, the present invention decreases radiation hazard to a user/wearer. In one embodiment, the present invention increases power efficiency. In one embodiment, the present invention increases power efficiency by reducing power consumption. In one embodiment, the present invention increases power efficiency by increasing antenna range. The present invention is particularly useful in multi-user wireless communications such as, for example, cellular and satellite communications.

Figure 1B:
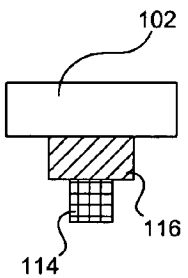
FIG. 1B is a partial cutaway top view along line X-Y of WDVA 100 of FIG. 1A.
Figure 1A:
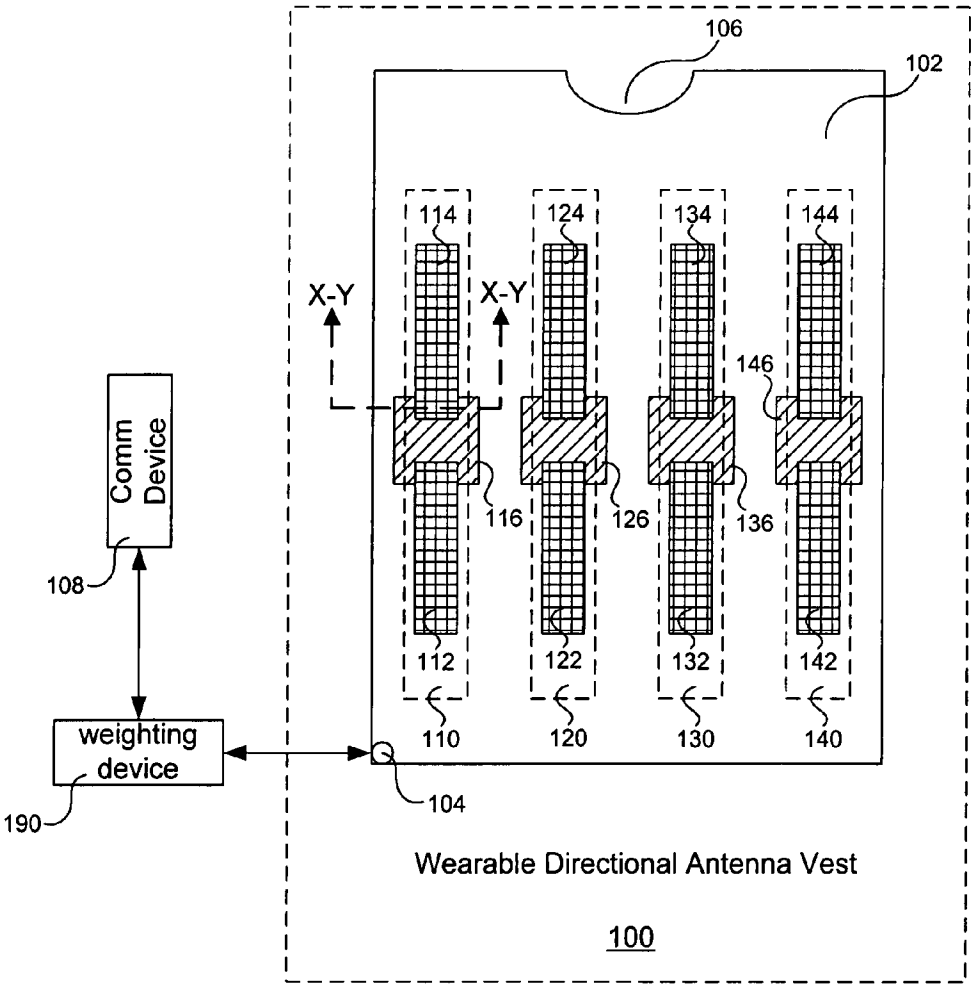
FIG. 1A is a front view of one embodiment of the present invention.

FIG. 1A is a front view of one embodiment of the present invention. As shown in FIG. 1A, wearable directional vest antenna (WDVA) 100 includes clothing 102, input/output (I/O) device 104, EM reflectors 116, 126, 136, 146 and antenna elements 110, 120, 130, 140. Clothing 102 comprises a nonconductive material. In the embodiment of the present invention of FIG. 1A, clothing 102 is a vest having neck hole 106. Those skilled in the art shall recognize that other clothing can be used with the present invention without departing from the scope or spirit of the present invention. Exemplary clothing that can be used with the present invention include, for example, tee shirts, dress shirts, jackets, sweaters and ponchos. In one embodiment, clothing 102 comprises a lightweight, washable, wearable, breathable material such as, for example, football jersey mesh and construction worker safety vest material. Clothing 102 is capable of being worn by a user in a comfortable manner.

EM reflectors 116, 126, 136, 146 are nonconductive energy reflectors that are operatively coupled to clothing 102. In one embodiment, EM reflectors 116, 126, 136, 146 are sewn to clothing 102. In one embodiment, EM reflectors 116, 126, 136, 146 are fastened to clothing 102 via hook-and-loop fasteners. In one embodiment, EM reflectors 116, 126, 136, 146 are glued to clothing 102. In one embodiment, EM reflectors 116, 126, 136, 146 comprise dielectric material and conductive metal. In one embodiment, EM reflectors 116, 126, 136, 146 comprise dielectric material having small amounts of conductive metal substantially evenly distributed through the dielectric material. In one embodiment, EM reflectors 116, 126, 136, 146 comprise conductive metal powder substantially evenly distributed through the dielectric material. In one embodiment, EM reflectors 116, 126, 136, 146 comprise material having extremely high resistance. In one embodiment, EM reflectors 116, 126, 136, 146 comprise insulator material. In one embodiment, EM reflectors 116, 126, 136, 146 comprise tubular composites. In one embodiment, EM reflectors 116, 126, 136, 146 comprise tubular composites having copper or iron tubules. In one embodiment, EM reflectors 116, 126, 136, 146 comprise copper or iron suspended in polyurethane or silicone. In one embodiment, EM reflectors 116, 126, 136, 146 comprise tubular composites having dimensions of approximately 25 microns in length and approximately 1 micron in diameter. EM reflectors 116, 126, 136, 146 are capable of reflecting energy without shorting antenna elements 110, 120, 130, 140. In one embodiment, EM reflectors 116, 126, 136, 146 are capable of reducing energy transmitted into a user wearing WDVA 100. In one embodiment, EM reflectors 116, 126, 136, 146 are capable of increasing antenna gain by decreasing power leakage into antenna element gaps.

Antenna elements 110, 120, 130, 140 comprise wearable, waterproof conductive material. In one embodiment, antenna elements 110, 120, 130, 140 comprise conductive cloth. In one embodiment, antenna elements 110, 120, 130, 140 comprise FlecTron®. In one embodiment, antenna elements 110, 120, 130, 140 comprise conductive material coated in plastic or similar waterproof coating. In one embodiment, the ends of antenna elements 110, 120, 130, 140 are spaced less than approximately 18 cm apart, which corresponds to a half wavelength for a typical cell phone frequency of 800 MHz. In one embodiment, antenna elements 110, 120, 130, 140 are unequally spaced. In one embodiment, antenna elements 110, 120, 130, 140 are approximately equally spaced. In one embodiment, antenna elements 110, 120, 130, 140 each have a length approximately equal to a half wavelength of a desired frequency.

As shown in FIG. 1A, each of antenna elements 110, 120, 130, 140 includes a pair of conductive strips. In one embodiment, each of antenna elements 110, 120, 130, 140 comprises a half wave dipole. In one embodiment, antenna elements 110, 120, 130, 140 comprise a half wave dipole that increases gain of each antenna element. Antenna element 110 includes conductive strips 112, 114; antenna element 120 includes conductive strips 122, 124; antenna element 130 includes conductive strips 132, 134; antenna element 140 includes conductive strips 142, 144. In one embodiment, conductive strips 112, 114, 122, 124, 132, 134, 142 and 144 each have a rectangular configuration. In one embodiment, conductive strips 112, 114, 122, 124, 132, 134, 142 and 144 each have a triangular configuration. Those skilled in the art shall recognize that other configurations of conductive strips 112, 114, 122, 124, 132, 134, 142 and 144 such as long oval configurations can be used with the present invention without departing from the scope or spirit of the present invention. As described in greater detail below with reference to FIG. 3, conductive strips 112, 114, 122, 124, 132, 134, 142 and 144 each have an AC feed from I/O device 104; and WDVA 100 can be used in conjunction with communication (comm) device 108 and weighting device 190. In one embodiment, the nulls of antenna radiation patterns from antenna elements 110, 120, 130, 140 are at the head and lower torso or groin of a user.

FIG. 1B is a partial cutaway top view along line X-Y of WDVA 100 of FIG. 1A. As shown in FIG. 1B, conductive strip 114 is operatively coupled to EM reflector 116. EM reflector 116 is operatively coupled to clothing 102.

Figure 2:
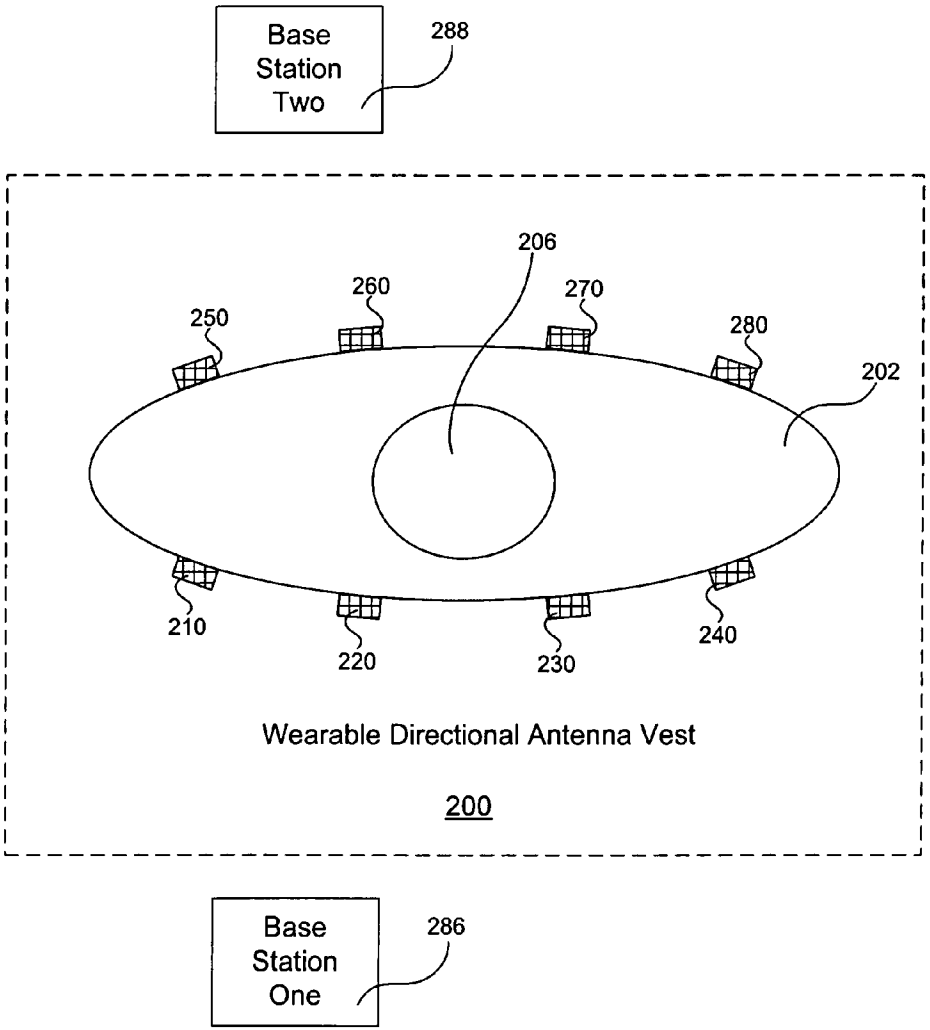
FIG. 2 is a top view of one embodiment of the present invention.

FIG. 2 is a top view of one embodiment of the present invention. As shown in FIG. 2, WDVA 200 includes clothing 202 and antenna elements 210, 220, 230, 240, 250, 260, 270, 280. WDVA 200, clothing 202 and antenna elements 210, 220, 230, 240 are analogous to WDVA 100, clothing 102 and antenna elements 110, 120, 130, 140 of FIG. 1A, and thus, are not described hereinagain. In the embodiment of the present invention of FIG. 2, clothing 202 is a vest having neck hole 206. WDVA 200 includes eight antenna elements. A front side of WDVA 200 includes antenna elements 210, 220, 230, 240. A back side of WDVA 200 includes antenna elements 250, 260, 270, 280. Those skilled in the art shall recognize that the present 6 invention can include different numbers of antenna elements without departing from the scope of spirit of the present invention. In one embodiment, WDVA 100 comprises six antenna elements (3 front/3 back).

In one embodiment, WDVA 200 operates by weighting antenna elements so that antenna elements pointed toward or facing a base station of interest have more power. For example, antenna elements 210, 220, 230 are weighted with more power when base station one 286 is the base station of interest. In particular, antenna element 220 can be weighted with the most power and antenna elements 210, 230 each can be weighted with the second most power. Similarly, antenna elements 250, 260, 270 are weighted with more power when base station two 288 is the base station of interest. In accordance with the present invention, specific antenna 6 elements can be energized to transmit or receive signals in a radiation pattern having a small angular width, which would considerably reduce radiation beam power. Also in accordance with the present invention, antenna elements 210–280 are capable of receiving and transmitting EM energy in a specified direction based on received power of reception signals. A WDVA system and exemplary operation of WDVA 200 is described in detail below with reference to FIGS. 3–6.

Figure 3:
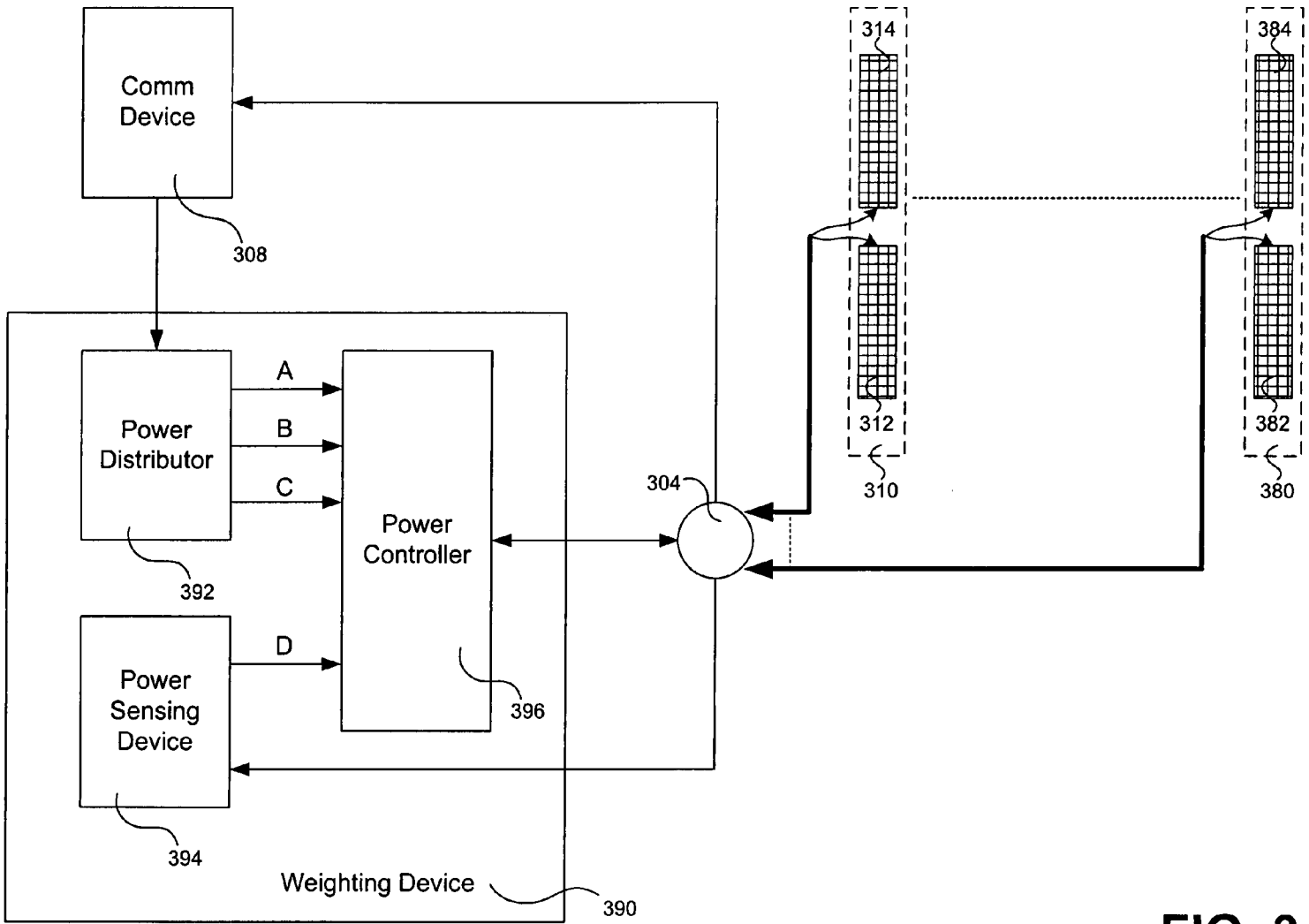
FIG. 3 is a block diagram of one embodiment of the present invention.

FIG. 3 is a block diagram of one embodiment of the present invention. As shown in FIG. 3, antenna elements 310–380, which are analogous to antenna elements 210–280 of WDVA 200 of FIG. 2, respectively, are operatively coupled to I/O device 304, which is analogous to I/O device 104 of FIG. 1A. In one embodiment, each of antenna elements 310–380 is operatively coupled to I/O device 304 via 2-wire cable. In one embodiment, each of antenna elements 310–380 is operatively coupled to I/O device 304 via cable in a 1-wire with shield configuration. Comm device 308 is operatively coupled to weighting device 390 and I/O device 304. In one embodiment, comm device 308 is a cellular telephone. In one embodiment, comm device 308 is a satellite telephone. In one embodiment, comm device 308 is a two-way pager. In one embodiment, comm device 308 is a Bluetooth™ enabled device. Comm device 308 receives signals from antenna elements 310–380. In one embodiment, comm device 308 receives signals from antenna elements 310–380 via I/O device 304. In one embodiment, comm device 308 receives signals from antenna elements 310–380 via weighting device 390. In one embodiment, comm device 308 receives signals from only selected antenna elements of antenna elements 310–380 via weighting device 390. In one embodiment, comm device 308 does not receive signals from selected antenna elements of antenna elements 310–380 via weighting device 390. Weighting device 390, which is analogous to weighting device 190 of FIG. 1A, is operatively coupled to I/O device 304 and comm device 308, which is analogous to comm device 108 of FIG. 1A. Weighting device 390 receives transmission signals from comm device 308 and outputs weighted signals to antenna elements 310–380 via I/O device 304. In one embodiment, weighting device 390 receives reception signals from antenna elements 310–380 via I/O device 304.

As shown in FIG. 3, weighting device 390 includes power distributor 392, power sensing device 394 and power controller 396. Power distributor 392 is operatively coupled to comm device 308 and power controller 396. Power distributor 392 receives transmission signals from comm device 308 and weights the transmission signals (i.e., sends a defined percentage of the total power to several antenna elements). Power distributor 392 outputs the weighted transmission signals to power controller 396. Power sensing device 394 receives reception signals from antenna elements 310–380 and determines relative strengths of received power from antenna elements 310–380. Power sensing device 394 outputs data (D) regarding relative strengths of received power to power controller 396. Power controller 396 is operatively coupled to power distributor 392 and power sensing device 394. Power controller 396 receives data (D) from power sensing device 394 regarding relative strengths of received power of antenna elements 310–380. Power controller 396 receives weighted transmission signals from power distributor 392. Power controller 396 outputs weighted transmission signals to selected antenna elements via I/O device 304 depending on the data (D) from power sensing device 394. Power distributor 392, power sensing device 394 and power controller 396 are described in greater detail hereinbelow with reference to FIGS. 4–6, respectively.

Figure 4:
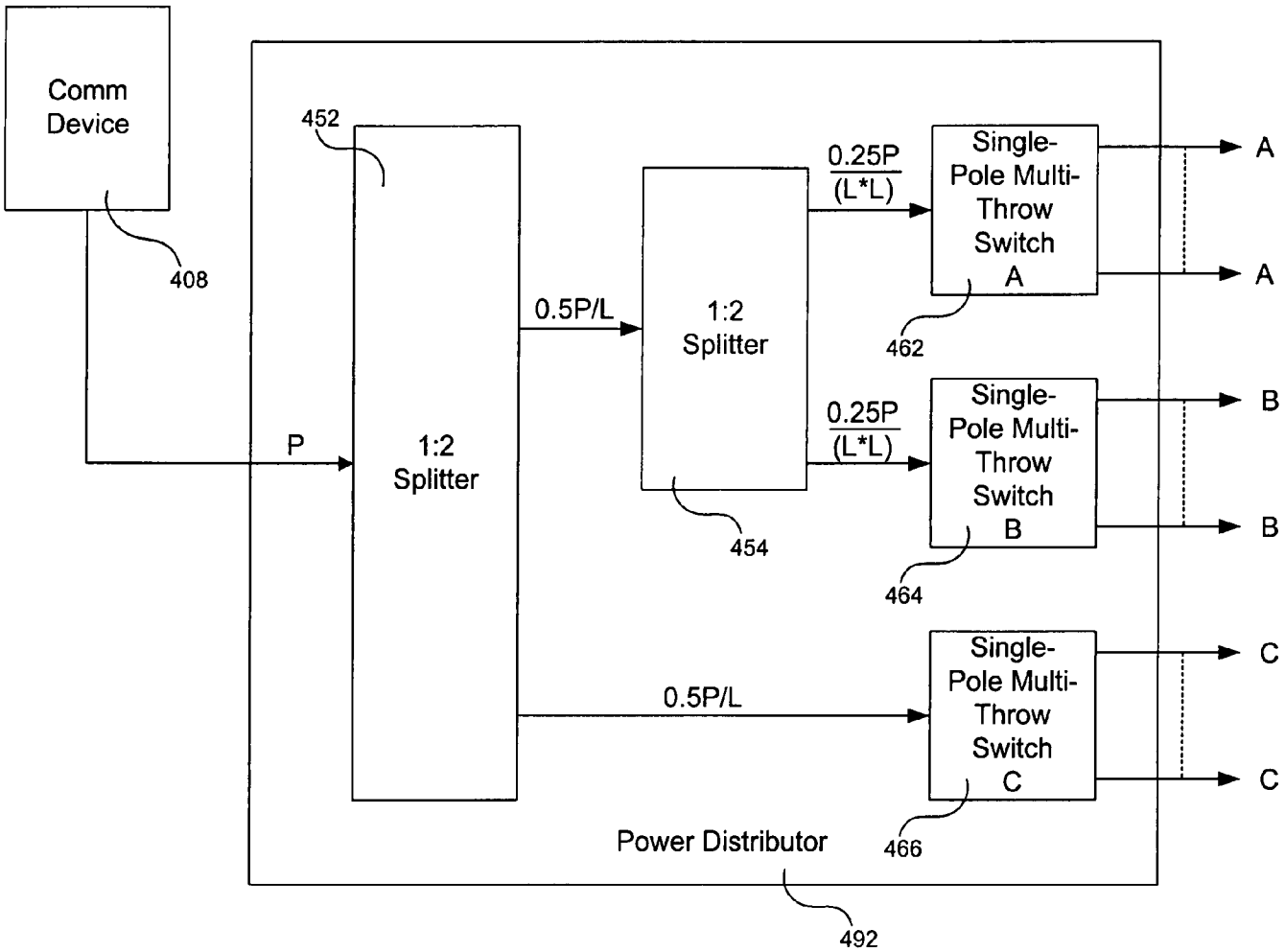
FIG. 4 is a block diagram of one embodiment of the present invention.

FIG. 4 is a block diagram of one embodiment of the present invention. As shown in FIG. 4, power distributor 492, which is analogous to power distributor 392 of FIG. 3, receives transmission signals from comm device 408, which is analogous to comm device 308 of FIG. 3. Power distributor 492 includes splitters 452, 454 and switches 462, 464, 466. Power distributor 492 receives transmission signals from comm device 408 and outputs weighted transmission signals. Splitter 452 receives transmission signals (P) from comm device 408. In one embodiment, splitter 452 is a 1:2 splitter, which is capable of splitting input transmission signals into two transmission signals having approximately half the power of the input transmission signals (P). Splitter 452 outputs half power transmission signals (0.5P/L) to splitter 454 and switch C 466. In one embodiment, splitter 452 outputs half power transmission signals (0.5P/L), which can be represented according to the following Equation 1.

$$\text{half power transmission signal}=((0.5)*(P))/L \qquad \text{(Equation 1)}$$

where,

P=input transmission signal

L=power loss due to combining

Splitter 454 receives half power transmission signals (0.5P/L) from splitter 452. In one embodiment, splitter 454 is a 1:2 splitter, which is capable of splitting half power transmission signals (0.5P/L) into two transmission signals having approximately quarter the power of the input transmission signals (P). Splitter 454 outputs quarter power transmission signals (0.25P/(L*L)) to switch A 462 and switch B 464. In one embodiment, splitter 454 outputs quarter power transmission signals (0.25P/(L*L)), which can be represented according to the following Equation 2.

$$\text{quarter power transmission signal}=((0.25)*(P))/(L*L) \qquad \text{(Equation 2)}$$

where,

P=input transmission signal

L=power loss due to combining

The value of power loss due to combining (L) is system dependent. In one embodiment, power loss due to combining (L) has a value between approximately 1.1 and approximately 2.

Switches A 462, B 464, C 466 can be MEMS switches. In one embodiment, switches A 462, B 464, C 466 operate with low power requirements. In one embodiment, switches A 462, B 464, C 466 are small. Switch A 462 and switch B 464 receive quarter power transmission signals (0.25P/(L*L)) from splitter 454. Switch A 462 outputs quarter power transmission signals (0.25P/(L*L)) to antenna elements of WDVA 100, 200, 300. In one embodiment, switch A 462 is a single-pole, multi-throw switch. In one embodiment, switch A 462 includes one input and eight outputs. In one embodiment, switch A 462 is operatively coupled to a power controller such as power controller 396 of FIG. 3. Switch B 464 is substantially similar to switch A 462, and thus, is not described in detail herein. Switch C 466 receives half power transmission signals (0.5P/L) from splitter 452. Switch C 466 outputs half power transmission signals (0.5P/L) to antenna elements of WDVA 100, 200, 300. In one embodiment, switch C 466 includes one input and eight outputs. In one embodiment, switch C 466 is operatively coupled to a power controller such as power controller 396 of FIG. 3.

Figure 5:
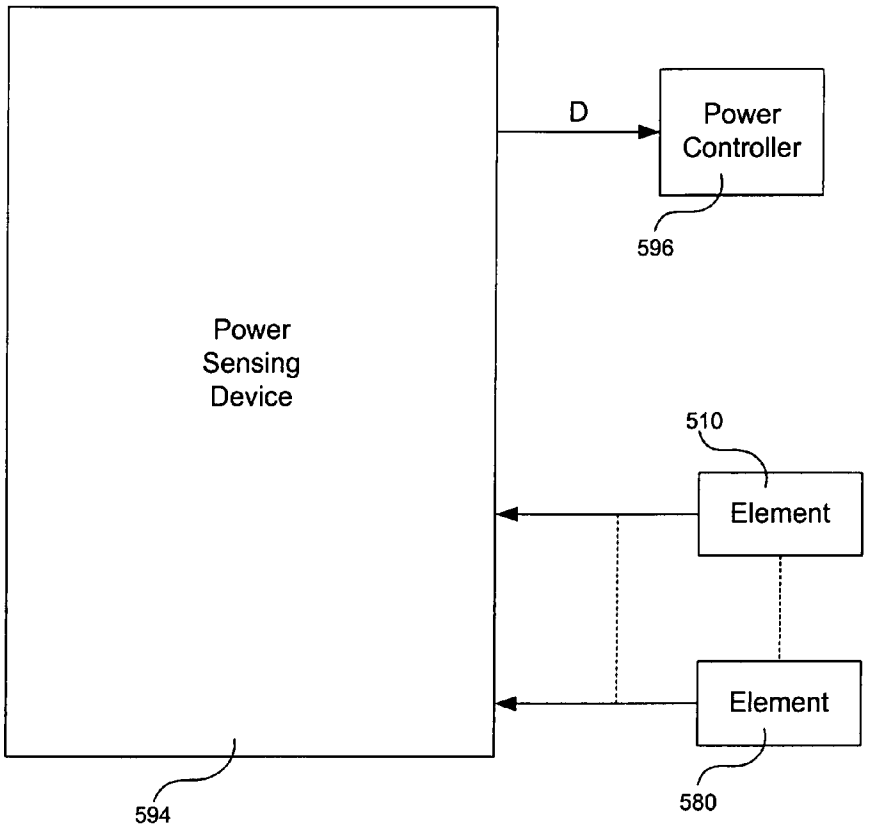
FIG. 5 is a block diagram of one embodiment of the present invention.

FIG. 5 is a block diagram of one embodiment of the present invention. As shown in FIG. 5, power sensing device 594, which is analogous to power sensing device 394 of FIG. 3, is operatively coupled to antenna elements 510–580, which are analogous to antenna elements 310–380 of FIG. 3, respectively. In one embodiment, power sensing device 594 is operatively coupled to antenna elements 510–580 via an I/O device. Power sensing device 594 is capable of receiving reception signals from antenna elements 510–580 and determining relative strengths of received power from antenna elements 510–580. In one embodiment, power sensing device 594 includes a multi-input comparator. In one embodiment, power sensing device 594 operates 8 periodically (e.g., once per second in a reception mode). Power sensing device 594 outputs data 9 (D) regarding relative strengths of received power to power controller 596, which is analogous to power controller 396 of FIG. 3.

Figure 6:
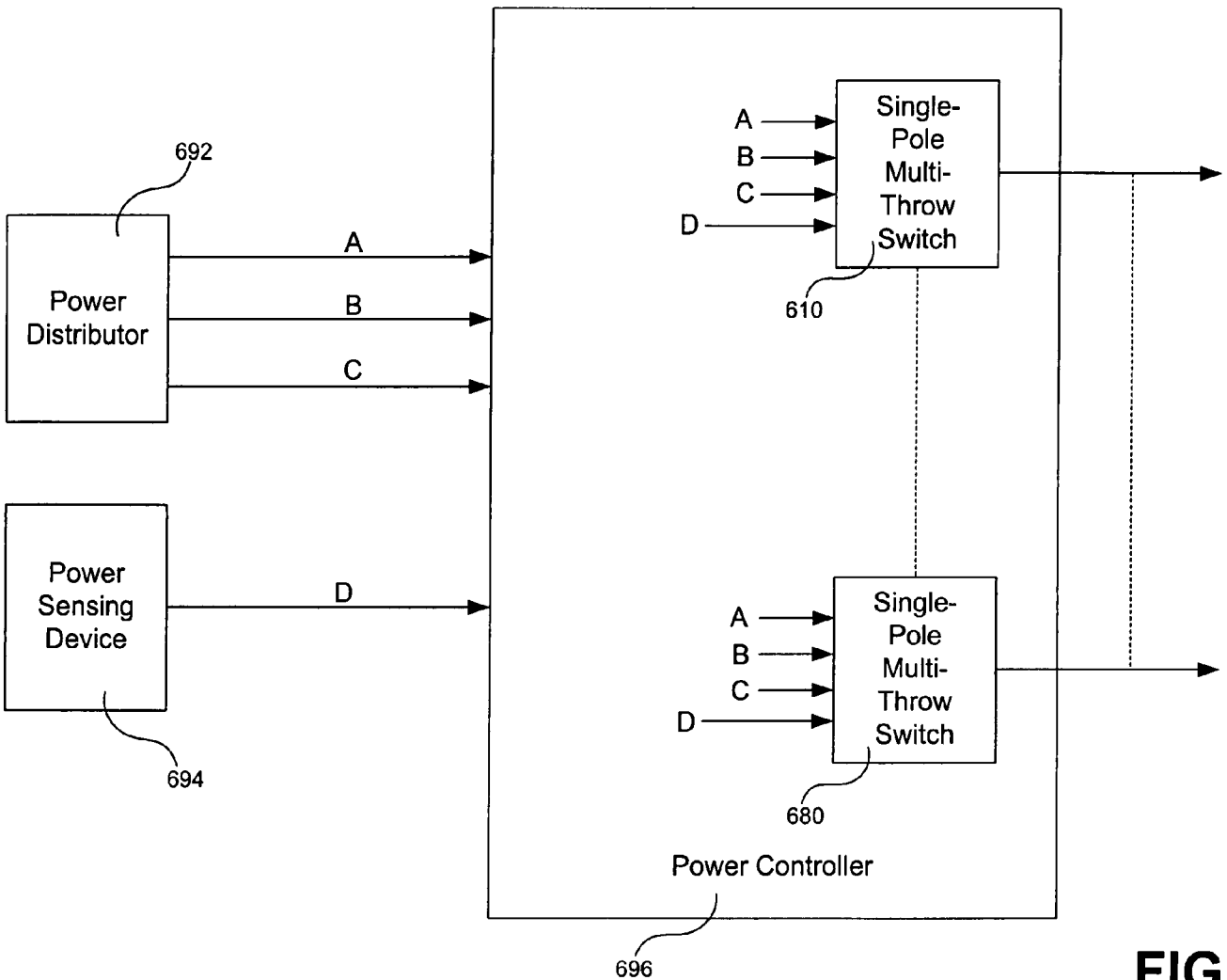
FIG. 6 is a block diagram of one embodiment of the present invention.

FIG. 6 is a block diagram of one embodiment of the present invention. As shown in FIG. 6, power controller 696, which is analogous to power controller 396 of FIG. 3, is operatively coupled to power distributor 692 and power sensing device 694, which are analogous to power distributor 392 and power sensing device 394 of FIG. 3, respectively. Power controller 696 is capable of receiving weighted transmission signals from power distributor 692 and data (D) from power sensing device 694. Power controller 696 is capable of selectively outputting weighted transmission signals to antenna elements based on data (D) from power sensing device 694. In one embodiment, power controller 696 includes a switch matrix. In one embodiment, power controller 696 includes an 8-by-8 switch matrix.

In one embodiment, power controller 696 includes parallel single-pole, multi-throw switches (SPMTS) 610–680 configured to each receive weighted transmission signals and data (D) from power distributor 692 and power sensing device 694, respectively. In one embodiment, power controller 696 includes eight SPMTS, which are operatively coupled to eight antenna elements such as antenna elements 310–380 of FIG. 3. In one embodiment, power controller 696 includes parallel single-pole, four-throw switches 610–680 configured to each receive weighted transmission signals and data (D) from power distributor 692 and power sensing device 694, respectively. In one embodiment, power controller 696 selects the highest power antenna element as determined by power sensing device 694 to receive half power transmission signals (0.5P/L) such as from switch C 466 of FIG. 4. In addition, power controller 696 selects antenna elements adjacent to the highest power antenna element to receive quarter power transmission signals (0.25P/(L*L)) such as from switches A 462 and B 464 of FIG. 4. In one embodiment, power controller 696 does not output transmission signals to antenna elements other than the antenna element having the highest received power and the two adjacent antenna elements.

An exemplary operation of the embodiments of FIGS. 2–6 is now described. As shown in FIG. 2, base station one 286 transmits signals to WDVA 200. Antenna elements 210–280 receive signals from base station one 286. As shown in FIG. 3, power sensing device 394 receives reception signals from antenna elements 310–380 via I/O device 304. As shown in FIG. 5, power sensing device 594 outputs data (D) regarding relative strengths of received power to power controller 596. In one embodiment, the power sensing operation is performed periodically (e.g., once per second in a reception mode). In the exemplary operation, antenna element 220, 320, 520 has the highest received power. As shown in FIG. 4, power distributor 492 receives transmission signals from comm device 408. Power distributor 492 splits input transmission signals via splitters 452, 454. Power distributor 492 outputs weighted transmission signals via switches A 462, B 464, C 466. As shown in FIG. 6, power controller 696 receives weighted transmission signals from power distributor 692 and data (D) from power sensing device 694. Power controller 696 selectively outputs half power transmission signals (0.5P/L) from switch C 466 of FIG. 4 to antenna element 220 of FIG. 2. In addition, power controller 696 selectively outputs quarter power transmission signals (0.25P/(L*L)) from switches A 462 and B 464 of FIG. 4 to adjacent antenna elements (i.e., antenna elements 210 and 230 of FIG. 2). Power controller 696 does not output transmission signals to antenna elements 240, 250, 260, 270, 280.

Figure 7:
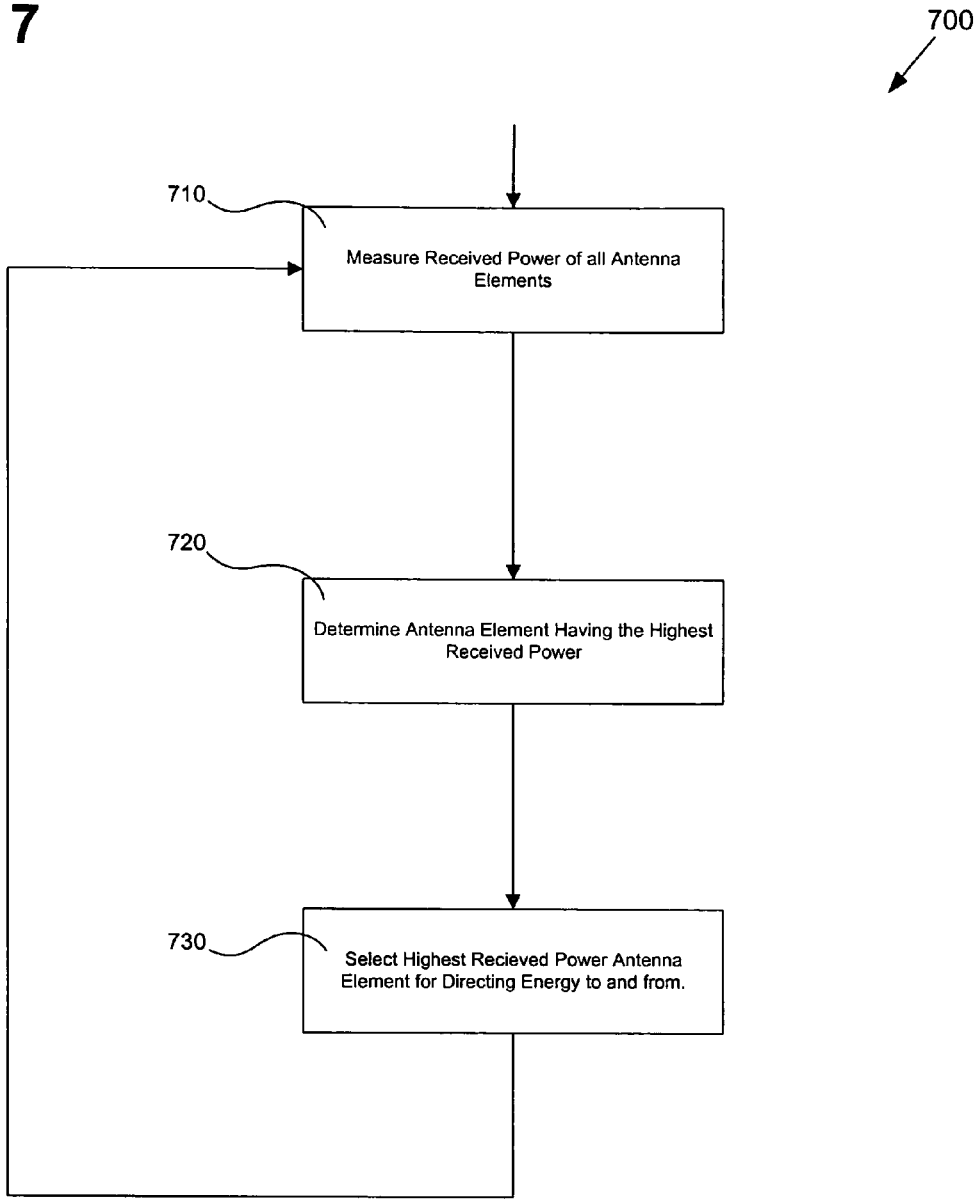
FIG. 7 is a flowchart of an exemplary application of the present invention.

FIG. 7 is a flowchart of an exemplary method of implementing an embodiment of the present invention. Certain details and features have been left out of flowchart 700 of FIG. 7 that are apparent to a person of ordinary skill in the art. For example, a step may consist of one or more sub-steps or may involve specialized equipment or materials, as known in the art. While STEPS 710 through 730 shown in flowchart 700 are sufficient to describe one embodiment of the present invention, other embodiments of the invention may utilize steps different from those shown in flowchart 700.

Referring to FIG. 7, at STEP 710 in flowchart 700, the method measures received power of all antenna elements. In one embodiment, the method measures received power of all antenna elements approximately every second when not transmitting. After STEP 710, the method of flowchart 700 of FIG. 7 proceeds to STEP 720.

At STEP 720 in flowchart 700, the method determines which antenna element has the highest received power. In one embodiment, the method uses a comparator. After STEP 720, the method proceeds to STEP 730.

At STEP 730 in flowchart 700, the method selects the highest received power antenna element for directing energy (e.g., signals) to and from. In one embodiment, a power distributor 6 and power controller are used to direct energy. After STEP 730, the method of flowchart 700 of FIG. 7 returns to STEP 710.

From the above description of the invention, it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. The described embodiments are to be considered in all respects as illustrative and not restrictive. It should also be understood that the invention is not limited to the particular embodiments described herein, but is capable of many rearrangements, modifications, and substitutions without departing from the scope of the invention.

I claim:

1. A wearable directional antenna, comprising:

a) a clothing comprising a non-conductive material;

b) a plurality of EM energy reflectors, operatively coupled to said clothing, capable of reflecting EM energy;

c) a plurality of antenna elements, operatively coupled to said plurality of EM energy reflectors, capable of receiving and transmitting EM energy in a specified direction wherein said plurality of EM energy reflectors do not short said plurality of antenna elements.

2. The wearable directional antenna of claim 1, wherein said clothing comprises a vest.

3. The wearable directional antenna of claim 1, wherein said plurality of EM energy reflectors comprises conductive metal tubules that are substantially evenly distributed in dielectric material.

4. The wearable directional antenna of claim 1, wherein said plurality of EM energy reflectors comprises tubular composite material.

5. The wearable directional antenna of claim 1, wherein said plurality of antenna elements is operatively coupled to said clothing and said plurality of EM energy reflectors.

6. The wearable directional antenna of claim 1, wherein antenna radiation patterns of said plurality of antenna elements have nulls at a head and lower torso of a user.

7. The wearable directional antenna of claim 1, wherein said plurality of antenna elements comprises conductive cloth.

8. The wearable directional antenna of claim 1, wherein said plurality of antenna elements comprises conductive cloth coated in waterproof material.

9. The wearable directional antenna of claim 1, wherein said plurality of antenna elements comprises a conductive, washable, wearable cloth.

10. The wearable directional antenna of claim 1, wherein said plurality of antenna elements receive and transmit EM energy in said specified direction by selectively outputting weighted signals to selected antenna elements.

11. The wearable directional antenna of claim 1, wherein each antenna element of said plurality of antenna elements has a length approximately equal to a half wavelength of a desired frequency.

12. The wearable directional antenna of claim 1, wherein each antenna element of said plurality of antenna elements comprises a half wave dipole antenna.

13. The wearable directional antenna of claim 1, wherein each antenna element of said plurality of antenna elements comprises a pair of conductive strips.

14. The wearable directional antenna of claim 1, further comprising a weighting device, operatively coupled to said plurality of antenna elements, capable of receiving transmission signals and outputting weighted signals to said plurality of antenna elements.

15. The wearable directional antenna of claim 14, wherein said weighting device further comprises:

i) a power sensing device, operatively coupled to said plurality of antenna elements, capable of receiving reception signals from said plurality of antenna elements and determining relative strengths of received power from each antenna element of said plurality of antenna elements, and capable of outputting data regarding relative strengths of received power from each antenna element;

ii) a power distributor, operatively coupled to a communication device, capable of receiving transmission signals from said communication device and outputting weighted transmission signals;

iii) a power controller, operatively coupled to said power sensing device and said power distributor, capable of receiving data from said power sensing device and weighted transmission signals from said power distributor, and capable of outputting weighted transmission signals to selected antenna elements of said plurality of antenna elements based on data from said power sensing device.

16. The wearable directional antenna of claim 15, wherein said power distributor comprises:

(1) a first splitter, operatively coupled to said communication device, capable of receiving transmission signals from said communication device and outputting half power transmission signals;

(2) a second splitter, operatively coupled to said first splitter, capable of receiving half power transmission signals from said first splitter and outputting quarter power transmission signals;

(3) a first switch, operatively coupled to said second splitter and said plurality of antenna elements, capable of receiving quarter power transmission signals and outputting quarter power transmission signals to selected antenna elements of said plurality of antenna elements;

(4) a second switch, operatively coupled to said second splitter and said plurality of antenna elements, capable of receiving quarter power transmission signals and outputting quarter power transmission signals to selected antenna elements of said plurality of antenna elements;

(5) a third switch, operatively coupled to said first splitter and said plurality of antenna elements, capable of receiving half power transmission signals and outputting half power transmission signals to selected antenna elements of said plurality of antenna elements.

17. The wearable directional antenna of claim 15, wherein said first switch, said second switch and said third switch comprise MEMS switches.

18. The wearable directional antenna of claim 15, wherein said power controller comprises a plurality of single-pole, multi-throw switches having a parallel configuration, wherein said plurality of single-pole, multi-throw switches is capable of outputting weighted transmission signals to said plurality of antenna elements.

19. The wearable directional antenna of claim 15, wherein said power controller comprises a plurality of single-pole, four-throw switches having a parallel configuration, wherein said plurality of single-pole, four-throw switches is capable of outputting weighted transmission signals to said plurality of antenna elements.

20. The wearable directional antenna of claim 15, wherein said power controller comprises a switch matrix.

21. The wearable directional antenna of claim 14, further comprising an I/O device, operatively coupled to said plurality of antenna elements and said weighting device.

* * * * *